US011040844B2

(12) United States Patent
Takahashi

(10) Patent No.: US 11,040,844 B2
(45) Date of Patent: Jun. 22, 2021

(54) RELAY CONVEYANCE DEVICE AND IMAGE FORMING APPARATUS

(71) Applicant: KYOCERA Document Solutions Inc., Osaka (JP)

(72) Inventor: Ryosuke Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 169 days.

(21) Appl. No.: 16/358,423

(22) Filed: Mar. 19, 2019

(65) Prior Publication Data

US 2019/0292002 A1 Sep. 26, 2019

(30) Foreign Application Priority Data

Mar. 22, 2018 (JP) ..... JP2018-055046

(51) Int. Cl.
*B65H 7/20* (2006.01)
*B65H 43/04* (2006.01)
*B65H 29/22* (2006.01)

(52) U.S. Cl.
CPC ..... *B65H 7/20* (2013.01); *B65H 29/22* (2013.01); *B65H 43/04* (2013.01); *B65H 2301/35* (2013.01); *B65H 2301/4452* (2013.01); *B65H 2513/10* (2013.01); *B65H 2801/27* (2013.01)

(58) Field of Classification Search
CPC . B65H 5/06; B65H 5/062; B65H 7/00; B65H 7/02; B65H 7/04; B65H 7/06; B65H 7/14; B65H 7/20; B65H 2301/35; B65H 2301/4452; B65H 2301/44522; B65H 2513/10; B65H 2513/104; B65H 2601/2525; B65H 43/00; B65H 43/02; B65H 43/04; B65H 43/08
See application file for complete search history.

(56) References Cited

U.S. PATENT DOCUMENTS 4,451,027 A * 5/1984 Alper ..... B65H 7/02 271/10.02
6,533,264 B1 * 3/2003 Tranquilla ..... B65H 5/062 271/10.02
6,687,570 B1 * 2/2004 Sussmeier ..... B65H 9/004 700/220
8,590,884 B2 11/2013 Maruta et al.
(Continued)

FOREIGN PATENT DOCUMENTS

JP 2013028434 A 2/2013

*Primary Examiner* — Prasad V Gokhale
(74) *Attorney, Agent, or Firm* — Studebaker & Brackett PC

(57) ABSTRACT

The relay conveyance device includes a relay conveyance path, a plurality of conveyance members, at least one detection member and a control device. The control device executes a correction processing such that, in a state where a first sheet and a second sheet positioned at the upstream side from the first sheet are conveyed along the relay conveyance path, a sheet interval from a detection end of the first sheet by the detection member to a detection start of the second sheet by the detection member is compared with a predetermined target value, when the sheet interval is smaller than the target value, the conveyance speed of the conveyance member is decreased so as to widen the sheet interval, and when the sheet interval is larger than the target value, the conveyance speed of the conveyance member is increased so as to shorten the sheet interval.

7 Claims, 10 Drawing Sheets

(56) References Cited

U.S. PATENT DOCUMENTS

| | | | | |
|---|---|---|---|---|
| 8,955,841 | B2 * | 2/2015 | Endo | B65H 7/02 271/270 |
| 2016/0370748 | A1 * | 12/2016 | Tani | G03G 15/6529 |
| 2018/0311975 | A1 * | 11/2018 | Kodama | B65H 29/125 |

* cited by examiner

RELAY CONVEYANCE DEVICE AND IMAGE FORMING APPARATUS

INCORPORATION BY REFERENCE

This application is based on and claims the benefit of priority from Japanese Patent application No. 2018-055046 filed on Mar. 22, 2018, which is incorporated by reference in its entirety.

BACKGROUND

The present disclosure relates to a relay conveyance device configured to convey a sheet from an image forming apparatus to a discharge device and an image forming system including the relay conveyance device.

An image forming system is known, which includes an image forming apparatus, a discharge device (for example, a post-processing device) and a relay conveyance device. The image forming apparatus forms an image on a sheet as a recording medium. To the discharge device, the sheet on which the image is formed by the image forming apparatus is discharged. The relay conveyance device relays the sheet from the image forming apparatus to the discharge device.

In the image forming system, since the sheets are continuously conveyed along a conveyance path, conveyance members are configured such that a sheet interval is maintained at a suitable distance. If the sheet interval is too short, a conveyance failure, such as a paper jamming, may occur; if the sheet interval is too long, a productivity (a number of the printed sheet per unit time) may de deteriorated.

For example, an image forming apparatus has a technique such that when two sheets are continuously conveyed, a feeding start timing at which the sheet is fed from a sheet feeding cassette is controlled based on a sheet interval time from a first sheet passing period to a second sheet detection period.

In the above technique, the feeding start timing is controlled based on the sheet interval time; however, a control for the interval of the sheets already fed and conveyed along the conveyance path is not particularly described. Accordingly, it is difficult to reduce a variation of the sheet interval during the conveyance, which is caused by external factor such as deterioration of the conveyance member, by applying the above technique.

SUMMARY

In accordance with an aspect of the present disclosure, a relay conveyance device includes a relay conveyance path, a plurality of conveyance members, at least one detection member and a control device. The relay conveyance path is arranged between an image forming apparatus forming an image on a sheet and a discharge device discharging the sheet on which the image is formed by the image forming apparatus. The sheet is conveyed along the relay conveyance path from the image forming apparatus to the discharge device. The plurality of conveyance members is provided along the relay conveyance path and configured to convey the sheet from an upstream side to a downstream side of the relay conveyance path. The detection member is provided along the relay conveyance path and configured to detect the sheet conveyed along the relay conveyance path by the conveyance members. The control device is configured to decrease or increase a conveyance speed of the conveyance members. The control device executes a correction processing such that, in a state where a first sheet and a second sheet positioned at the upstream side from the first sheet are conveyed along the relay conveyance path, a sheet interval from a detection end of the first sheet by the detection member to a detection start of the second sheet by the detection member is compared with a predetermined target value, when the sheet interval is smaller than the target value, the conveyance speed of the conveyance member is decreased so as to widen the sheet interval, and when the sheet interval is larger than the target value, the conveyance speed of the conveyance member is increased so as to shorten the sheet interval.

In accordance with an aspect of the present disclosure, an image forming system includes an image forming apparatus, a discharge device and a relay conveyance device. The image forming apparatus is configured to form an image on a sheet. The discharge device is configured to discharge the sheet on which the image is formed by the image forming apparatus. The relay conveyance device is configured to relay the sheet from the image forming apparatus to the discharge device. The relay conveyance device includes a relay conveyance path, a plurality of conveyance members, at least one detection member and a control device. The relay conveyance path is arranged between an image forming apparatus forming an image on a sheet and a discharge device discharging the sheet on which the image is formed by the image forming apparatus. The sheet is conveyed along the relay conveyance path from the image forming apparatus to the discharge device. The plurality of conveyance members is provided along the relay conveyance path and configured to convey the sheet from an upstream side to a downstream side of the relay conveyance path. The detection member is provided along the relay conveyance path and configured to detect the sheet conveyed along the relay conveyance path by the conveyance members. The control device is configured to decrease or increase a conveyance speed of the conveyance members. The control device executes a correction processing such that, in a state where a first sheet and a second sheet positioned at the upstream side from the first sheet are conveyed along the relay conveyance path, a sheet interval from a detection end of the first sheet by the detection member to a detection start of the second sheet by the detection member is compared with a predetermined target value, when the sheet interval is smaller than the target value, the conveyance speed of the conveyance member is decreased so as to widen the sheet interval, and when the sheet interval is larger than the target value, the conveyance speed of the conveyance member is increased so as to shorten the sheet interval.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming system according to an embodiment will be described. Arrows L, R, U and Lo suitably marked in each figure respectively indicate a left side, a right side, an upper side and a lower side of the image forming system. Hereinafter, "an upstream (side)" and "a downstream (side)" described in below respectively indicate "an upstream (side)" and "a downstream (side)" in a conveyance direction of a sheet in the image forming system.

1. Configuration of the Image Forming System

Figure 1:
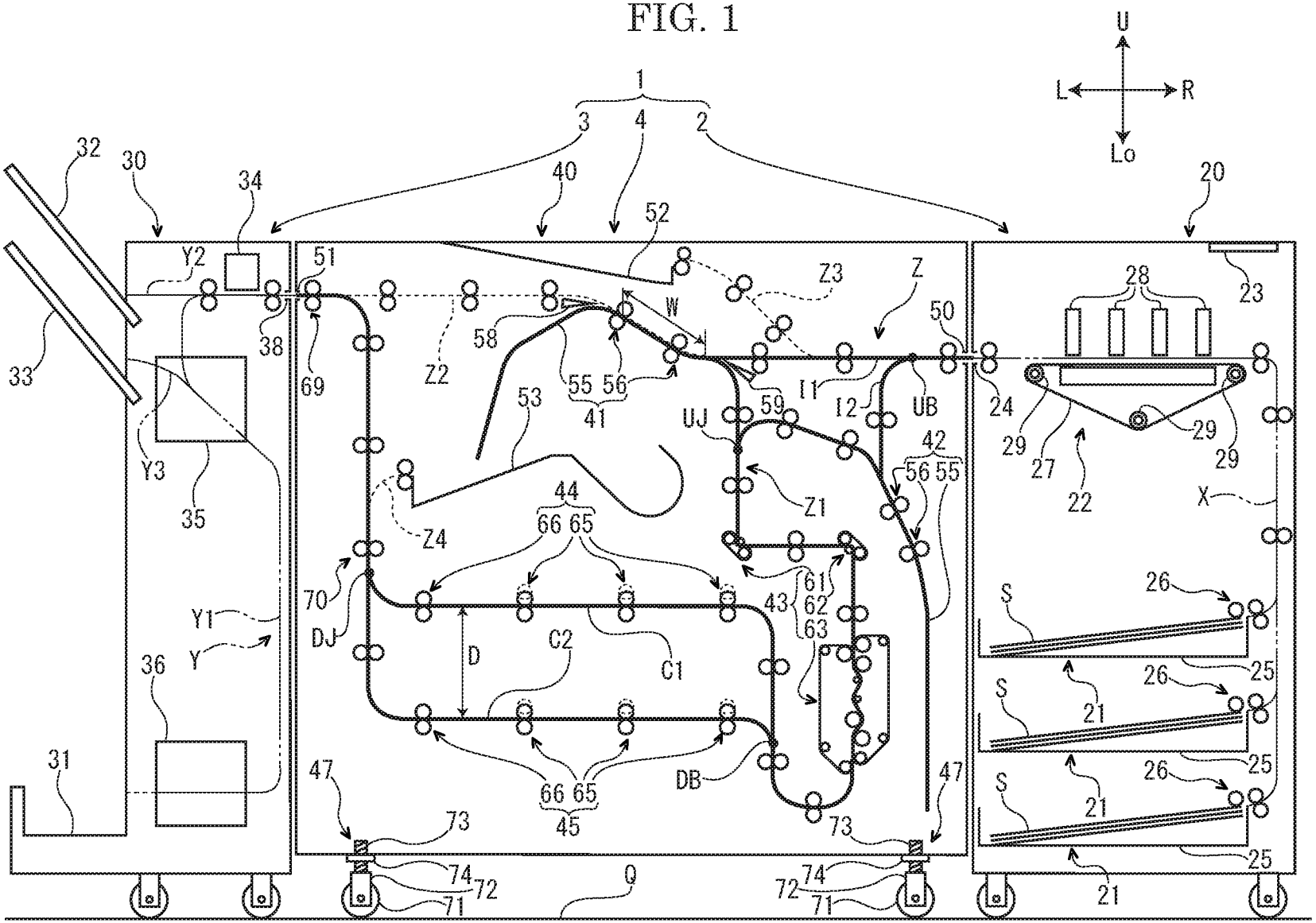
FIG. 1 is a sectional view showing an image forming system according to one embodiment of the present disclosure.

With reference to FIG. 1, an image forming system 1 according to the embodiment of the present disclosure will be described. In the following description, a near side of a paper surface of FIG. 1 is defined to be a front side of the image forming system 1, for convenience of explanation.

As shown in FIG. 1, the image forming system 1 is provided with an image forming apparatus 2, a post-processing device 3 (a discharge device) and a relay conveyance device 4. The image forming apparatus 2 forms an image on a sheet S. The post-processing device 3 discharges the sheet on which the image is formed by the image forming apparatus 2. The relay conveyance device 4 relays the sheet from the image forming apparatus 2 to the post-processing device 3.

1-1. Configuration of the Image Forming Apparatus

As shown in FIG. 1, the image forming apparatus 2 includes a box-shaped apparatus main body 20, a plurality of sheet feeding parts 21 stored in a lower portion of the apparatus main body 20 and an image forming part 22 stored in an upper portion of the apparatus main body 20. Inside the apparatus main body 20 of the image forming apparatus 2, an upstream side conveyance path X along which the sheet S is conveyed is provided. At a downstream end portion of the upstream side conveyance path X, an upstream side discharge port 24 is provided. The upstream side discharge port 24 is opened to an upper portion of a left side face (a face at a side of the relay conveyance device 4) of the apparatus main body 20.

The sheet feeding parts 21 of the image forming apparatus 2 are arranged at an upstream end portion of the upstream side conveyance path X. The sheet feeding parts 21 are aligned in the upper-and-lower direction. Each sheet feeding part 21 includes a sheet feeding cassette 25 storing the sheet S and a sheet feeding mechanism 26 arranged at a right upper side of the sheet feeding cassette 25. The sheet S is made of paper, synthetic resin or fabric.

The image forming part 22 of the image forming apparatus 2 is arranged at a downstream portion of the upstream side conveyance path X. The image forming part 22 adopts an inkjet type image forming method. The image forming part 22 includes a conveyance belt 27 and four recording heads 28 arranged above the conveyance belt 27. The conveyance belt 27 is wound around a plurality of rollers 29 and supported by the rollers 29 in a rotatable manner. The recording heads 28 are configured to be capable of ejecting inks of different colors.

It is obviously understood that the image forming part 22 adopts an electrophotographic type image forming method instead of the inkjet type image forming method.

The image forming apparatus 2 includes a control device (not shown) and a touch panel 23 on which information is displayed for a user and through which an operation instruction from the user is received.

1-2. Operation of the Image Forming Apparatus

The sheet feeding mechanism 26 in each sheet feeding part 21 feeds the sheet S from the sheet feeding cassette 25 to the upstream side conveyance path X. The sheet S fed to the upstream side conveyance path X is conveyed to the downstream side along the upstream side conveyance path X, and then enters the image forming part 22. The sheet S entered the image forming part 22 is adsorbed on an upper face of the conveyance belt 27, and conveyed to the downstream side as the conveyance belt 27 is rotated. Each recording head 28 ejects the ink downward to the sheet S adsorbed on the upper face of the conveyance belt 27. This forms an image on the sheet S. The sheet S on which the image is formed is further conveyed to the downstream side along the upstream side conveyance path X and then discharged from the upstream side conveyance path X through the upstream side discharge port 24.

1-3. Configuration of the Post-Processing Device

As shown in FIG. 1, the post-processing device 3 includes a casing 30, a plurality of discharge trays 31 to 33 protruding from a left side face of the casing 30 and a plurality of post-processing mechanisms 34 to 36 stored in the casing 30. The post-processing device 3 is a device called a finisher, conventionally.

Inside the casing 30 of the post-processing device 3, a downstream side conveyance path Y along which the sheet S is conveyed is provided. The downstream side conveyance path Y includes a first path Y1, a second path Y2 branched from an upstream portion of the first path Y1 and a third path Y3 branched from a midstream portion of the first path Y1. At an upstream end portion of the first path Y1, a downstream side introduction port 38 is provided. The downstream side introduction port 38 is opened to an upper portion of a right side face (a face at a side of the relay conveyance device 4) of the casing 30.

The discharge trays 31 to 33 of the post-processing device 3 include the first discharge tray 31 arranged at a downstream end portion of the first path Y1, the second discharge tray 32 arranged at a downstream end portion of the second path Y2 and the third discharge tray 33 arranged at a downstream end portion of the third path Y3.

The post-processing mechanisms 34 to 36 of the post-processing device 3 include the punching mechanism 34 arranged at the upstream portion of the first path Y1, the staple mechanism 35 arranged at a branch portion of the first path Y1 and the third path Y3 and the sheet folding mechanism 36 arranged at a downstream portion of the first path Y1.

1-4. Operation of the Post-Processing Device

The sheet S on which the image is formed by the image forming apparatus 2 is discharged to the post-processing device 3 through the relay conveyance device 4 (described later in detail), and then introduced to the first path Y1 through the downstream side introduction port 38. The sheet S introduced to the first path Y1 enters the punching mechanism 34. The punching mechanism 34 subjects a punching processing to the sheet S if needed. The first sheet S passed through the punching mechanism 34 enters the second path Y2, and then is discharged to the second discharge tray 32 from the downstream end portion of the second path Y2. The second sheet S passed through the punching mechanism 34 is further conveyed to the downstream side along the first path Y1 and then enters the staple mechanism 35. The staple mechanism 35 subjects a staple processing to the sheet S if needed.

The first sheet S passed through the staple mechanism 35 enters the third path Y3, and then is discharged to the third discharge tray 33 from the downstream end portion of the third path Y3. The second sheet S passed through the staple mechanism 35 is further conveyed to the downstream side along the first path Y1 and then enters the sheet folding mechanism 36. The sheet folding mechanism 36 subjects a sheet folding processing to the sheet S if needed. The sheet S passed through the sheet folding mechanism 36 is discharged to the first discharge tray 31 from the downstream end portion of the first path Y1.

1-5. Configuration of the Relay Conveyance Device

As shown in FIG. 1, the relay conveyance device 4 is provided separately from the image forming apparatus 2 and the post-processing device 3. The relay conveyance device 4 is detachably coupled to the image forming apparatus 2 and the post-processing device 3. The relay conveyance device 4 is a device called a bridge unit, conventionally.

The relay conveyance device 4 includes a casing 40, first and second inversion units 41 and 42, a curl correction unit 43, first and second correction units 44 and 45 and a height adjustment unit 47. The first and second inversion units 41 and 42 are respectively stored in an upper space and a right side space of the casing 40. The curl correction unit 43 is stored in a right lower space of the casing 40. The first and second correction units 44 and 45 are stored in a lower space of the casing 40. The height adjustment units 47 are attached to four corners of a bottom wall of the casing 40. The units 41 to 45 are arranged in the order of the inversion units 41 and 42, the curl correction unit 43 and the correction units 44 and 45 from the upstream side to the downstream.

Inside the casing 40 of the relay conveyance device 4, a relay conveyance path Z along which the sheet S is conveyed is provided. The relay conveyance path Z includes a main path Z1, a first sub-path Z2, a second sub-path Z3 and an escape path Z4. In FIG. 1, the main path Z1 is shown by a wide line, and the first sub-path Z2, the second sub-path Z3 and the escape path Z4 are shown by dotted lines.

The main path Z1 of the relay conveyance path Z is arranged between the upstream side conveyance path X of the image forming apparatus 2 and the downstream side conveyance path Y of the post-processing device 3, and relays the sheet S from the upstream side conveyance path X to the downstream side conveyance path Y.

At an upstream end portion of the main path Z1, a relay introduction port 50 is provided. The relay introduction port 50 is opened to an upper portion of a right side face (a face at a side of the image forming apparatus 2) of the casing 40, and faces the upstream side discharge port 24 of the image forming apparatus 2. At a downstream end portion of the main path Z1, a relay discharge port 51 is provided. The relay discharge port 51 is opened to an upper portion of a left side face (a face at a side of the post-processing device 3) of the casing 40, and faces the downstream side introduction port 38 of the post-processing device 3.

The main path Z1 of the relay conveyance path Z is branched at an upstream side brunch point UB into a first inversion path I1 and a second inversion path I2. The first inversion path I1 and the second inversion path I2 are joined at an upstream side join point UJ provided at the downstream side of the upstream side brunch point UB. The main path Z1 is branched at a downstream side brunch point DB provided at the downstream side of the upstream side join point UJ into a first correction path C1 and a second correction path C2. The first correction path C1 and the second correction path C2 are joined at a downstream side join point DJ provided at the downstream side of the downstream side brunch point DB.

The first sub-path Z2 of the relay conveyance path Z is branched from the first inversion path I1 of the main path Z and joined to the downstream end portion of the main path Z1. The first sub-path Z2 is provided at the upper space of an inner space of the casing 40.

The second sub-path Z3 of the relay conveyance path Z is branched from the first inversion path I1 of the main path Z. At a downstream end portion of the second sub-path Z3, a support tray 52 is arranged. The support tray 52 is provided on an upper face of the casing 40.

The escape path Z4 of the relay conveyance path Z is branched from the main path Z1 at the downstream side of the downstream side join point DJ. At a downstream end portion of the escape path Z4, an escape tray 53 is arranged. The escape tray 53 is provided in the inner space of the casing 40.

The first inversion unit 41 of the relay conveyance device 4 is arranged on the first inversion path I1 of the main path Z1. The second inversion unit 42 of the relay conveyance device 4 is arranged on the second inversion path I2 of the main path Z1. That is, the first and second inversion units 41 and 42 are arranged in parallel on the main path Z1.

Each of the first and second inversion units 41 and 42 includes an inversion area 55 and two pairs of inversion rollers 56 arranged at an upstream portion of the inversion area 55. The upstream portion of the inversion area 55 of the first inversion unit 41 is overlapped with an upstream portion of the first sub-path Z2. That is, the inversion area 55 of the first inversion unit 41 is partially shared with the first sub-path Z2. A reference W in FIG. 1 shows a share portion of the inversion area 55 of the first inversion unit 41 and the first sub-path Z2 (hereinafter, called "a share portion W"). At the downstream side (the left side) of the share portion W, a first brunch claw 58 is provided, and at the upstream side (the right side) of the share portion W, a second brunch claw 59 is provided.

The curl correction unit 43 of the relay conveyance device 4 is arranged between the upstream side join point UJ and the downstream side brunch point DB of the main path Z1. The curl correction unit 43 is arranged at the downstream side of the first and second inversion units 41 and 42. The curl correction unit 43 includes a first curl correction mechanism 61, a second curl correction mechanism 62 provided at the downstream side of the first curl correction mechanism 61 and a third curl correction mechanism 63 provided at the downstream side of the second curl correction mechanism 62.

The first correction unit 44 of the relay conveyance device 4 is arranged on the first correction path C1 of the main path Z1, and the second correction unit 45 is arranged on the second correction path C2 of the main path Z1. That is, the first and second correction units 44 and 45 are arranged in parallel on the main path Z1. The first and second correction units 44 and 45 are aligned in the upper-and-lower direction. The first and second correction units 44 and 45 are arranged at the downstream side of the first and second inversion units 41 and 42 and the curl correction unit 43.

Each of the first and second correction units 44 and 45 includes three pairs of switch rollers 65 and a pair of correction rollers 66 arranged at the downstream side of the three pairs of switch rollers 65. The three pairs of switch rollers 65 and the pair of correction rollers 66 are arranged at intervals in the left-and-right direction (a horizontal direction). An upper roller of the switch rollers is configured to be movable in the upper-and-lower direction between a nip position (refer to a solid line in FIG. 1) and a nip release position (refer to a dotted line in FIG. 1). In the nip position, the sheet S entered each of the correction paths C1 and C2 is put between the upper roller and a lower roller of the switch rollers 65. In the nip release position, the sheet S entered each of the correction paths C1 and C2 is released from the upper roller and the lower roller of the switch rollers 65. The pair of correction rollers 66 is configured to be movable in the front-and-rear direction (the direction perpendicular to the conveyance direction of the sheet S).

Hereinafter, the roller, which is provided along the relay conveyance path Z and conveys the sheet S from the upstream side to the downstream side along the relay conveyance path Z, is sometimes called a conveyance roller CR generally, and the conveyance roller CR includes the pairs of inversion rollers 56, the pairs of switch rollers 65, the pairs of correction rollers 66, the pair of discharge rollers 69 and the pair of conveyance rollers 70 which are described above. The conveyance roller CR is typically composed of a pair of rollers; however, the conveyance roller CR may include a single roller which is not a pair of rollers, such as the roller of the third curl correction mechanism 63.

Each of the height adjustment unit 47 of the relay conveyance device 4 includes a caster 71, a supporting member 72, a bolt 73 and a nut 74. The caster 71 is placed on a placement surface Q on which the image forming system 1 is placed. The supporting member 72 supports the caster 71 in a rotatable manner. The bolt 73 is fixed to the supporting member 72, and the nut 74 is engaged with the bolt 73. The bolt 73 is penetrated through the bottom wall of the casing 40. The nut 74 comes into contact with a lower face of the bottom wall of the casing 40.

The relay conveyance device 4 includes a plurality of sheet detection sensors SD (a detection member). The sheet detection sensor SD is a device which is provided on the relay conveyance path Z and detects the sheet S conveyed along the relay conveyance path Z by the conveyance roller CR. The sheet detection sensor SD is an infrared sensor, for example. The sheet detection sensor SD is switched into an ON state when the sheet S exists within a detection area on the relay conveyance path Z (the sheet S is passing through the detection area) and into an OFF state when the sheet S does not exist within the detection area. An output of each sheet detection sensor SD is inputted to a relay control device 80 described later.

Figure 2:
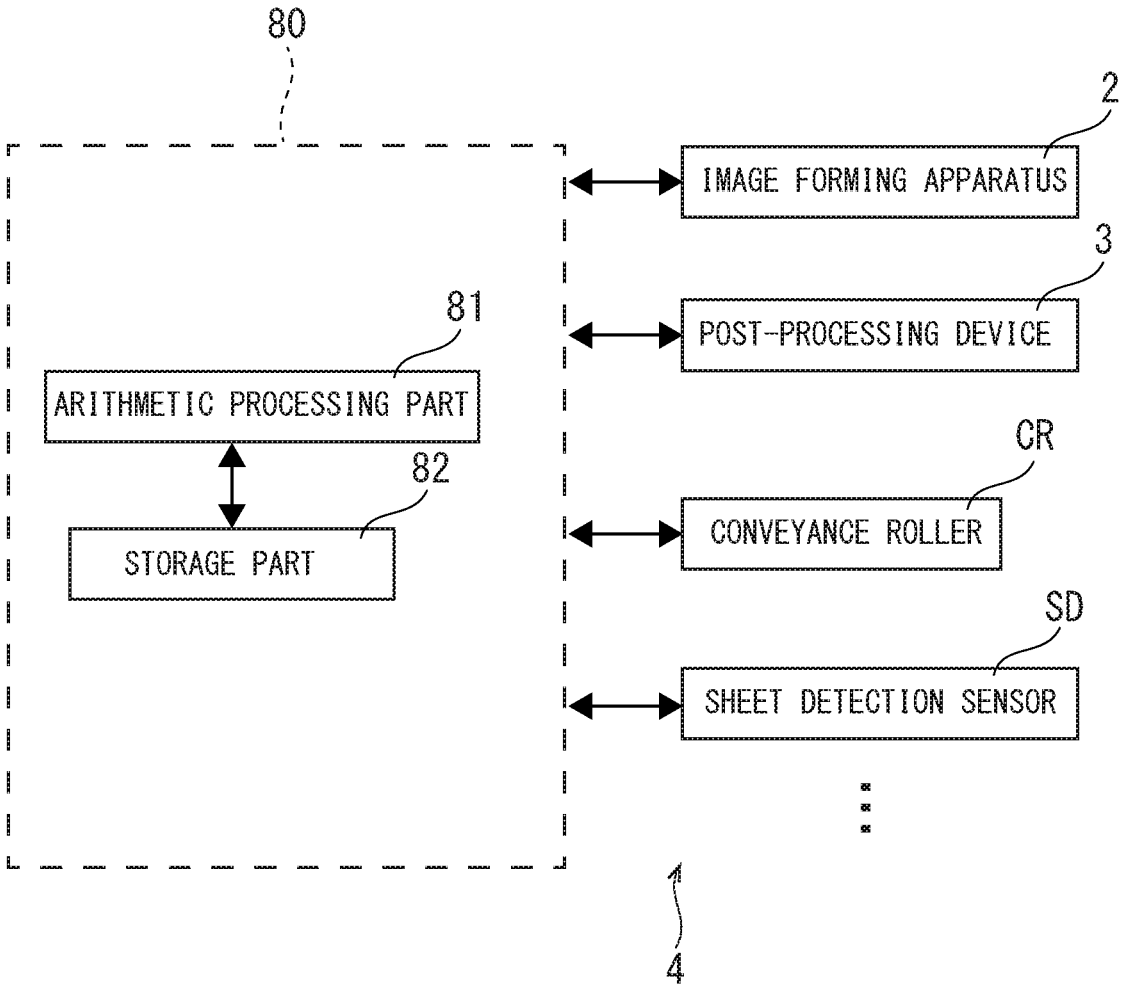
FIG. 2 is a block diagram showing a control device provided in a relay conveyance device according to the embodiment of the present disclosure.

As shown in FIG. 2, the relay conveyance device 4 includes the relay control device 80 (a control device). The relay control device 80 is a device constructed by a microcomputer, and includes an arithmetic processing part 81 and a storage part 82. The arithmetic processing part 81 includes a microprocessor as a CPU (central processing unit), and the storage part 82 includes a ROM (read only memory) and RAM (random access memory). The ROM is a readable recording memory storing a program used for boot processing and control of the relay conveyance device 4 and the others. A target value T of a sheet interval IN described later is also stored in the ROM of the storage part 82. The RAM is a readable and writable recording medium, serves as a main storage device and stores written information. The storage part 82 may include an auxiliary storage device, such as a flash memory.

The arithmetic processing part 81 executes a predetermined processing referring to the information stored in the RAM according to the program stored in the ROM. The arithmetic processing part 81 logically builds various function blocks achieved by the processing according the program. The arithmetic processing part 81 writes various information obtained by the processing in the storage part 82.

The relay control device 80 is electrically connected to each part of the relay conveyance device 4, such as the conveyance roller CR and the sheet detection sensor SD. The relay control device 80 is electrically connected to the control device (not shown) of the image forming apparatus 2 and the control device (not shown) of the post-processing device 3.

1-6. Operation of the Relay Conveyance Device

The sheet S on which the image is formed is discharged through the upstream side discharge port 24 from the upstream side conveyance path X of the image forming apparatus 2, and then introduced into the main path Z1 through the relay introduction port 50. The sheets S are continuously introduced into the main path Z1 at predetermined intervals.

The first sheet S of the sheets S introduced into the main path Z1 continuously enters the first inversion path I1. The first inversion unit 41 inverts the sheet S entered the first inversion path I1 as follows.

First, each pair of inversion rollers 56 of the first inversion unit 41 is rotated in one direction to introduce the sheet S into the inversion area 55 of the first inversion unit 41. At this time, the first brunch claw 58 directs a read portion of the sheet S to the downstream portion (the downstream portion from the share portion W) of the inversion area 55 of the first inversion unit 41. Then, each pair of inversion rollers 56 of the first inversion unit 41 is rotated in the counter direction to the one direction to reverse the conveyance direction of the sheet S. This inverts the sheet S. The read portion of the sheet S whose conveyance direction is reversed is directed to the downstream side of the first inversion path I1 by the second brunch claw 59 and guided to the upstream side join point UJ.

The second sheet S of the sheets introduced into the main path Z1 continuously enters the second inversion path I2. The second inversion unit 42 inverts the sheet S entered the second inversion path I2. The operation to invert the sheet S by the second inversion unit 42 is the same as the operation to invert the sheet S by the first inversion unit 41, and its explanation is omitted.

At the upstream side brunch point UB of the main path Z1, an upstream side brunch guide (not shown) is provided. By the upstream side brunch guide, the sheets S introduced into the main path Z1 continuously at predetermined intervals are guided to the first inversion path I1 and to the second inversion path I2 alternately. Thereby, the sheets S are introduced into the first inversion unit 41 and into the second inversion unit 42 alternately.

A configuration that the sheets S introduced into the main path Z1 continuously at predetermined intervals are continuously introduced into one of the first inversion path I1 and the second inversion path I2 may be adopted. For example, a configuration that when one print job instructs a printing for the plurality of sheets S, the sheets S are introduced into one of the first inversion path I1 and the second inversion path I2 may be adopted.

The sheet S which is inverted by the first inversion unit 41 or the second inversion unit 42 as described above is passed through the upstream side join point UJ, and then enters the curl correction unit 43. The curl correction unit 43 corrects the curl of the sheet S.

The first sheet S of the sheets S whose curl is corrected enters the first correction path C1. The first correction unit 44 corrects the position of the sheet S entered the first correction path C1 in the front-and-rear direction (the near-and-far direction of FIG. 1) as follows.

First, a sheet front-and-rear position sensor (not shown) detects the position of the sheet S in the front-and-rear direction. Next, in a state where the sheet S is put between the switch rollers 65 and between the correction rollers 66 of each pair of the first correction unit 44, the rotation of the switch rollers 65 and the correction rollers 66 of each pair of the first correction unit 44 is temporality stopped. Then, the upper roller of the switch rollers 65 of each pair of the first correction unit 44 is moved from the nip position (refer the solid line in FIG. 1) to the nip-release position (refer to the dotted line in FIG. 1).

Next, the pair of correction rollers 66 of the first correction unit 44 is moved based on a detection result of the above sheet front-and-rear position sensor in the front-and-rear direction with the sheet S put between the rollers 66. For example, in a case where the above sheet front-and-rear position detection sensor detects that the sheet S is displaced from a reference position forward by 1 mm, the pair of correction rollers 66 of the first correction unit 44 moves rearward by 1 mm. In contrast, in a case where the above sheet front-and-rear position detection sensor detects that the sheet S is displaced from the reference position rearward by 1 mm, the pair of correction rollers 66 of the first correction unit 44 moves forward by 1 mm. Thereby, the position of the sheet S is corrected in the front-and-rear direction.

After the position of the sheet S is corrected in the front-and-rear direction, the upper roller of the switch rollers 65 of each pair of the first correction unit 44 is moved from the nip-release position (refer to the dotted line in FIG. 1) to the nip position (refer to the solid line in FIG. 1). Then, the rotation of the rollers 65 and 66 of each pair of the first correction unit 44 is restarted.

The second sheet S of the sheets S whose curl is corrected enters the second correction path C2. The second correction unit 45 corrects the position of the sheet S entered the second correction path C2 in the front-and-rear direction. The operation to correct the position of the sheet S in the front-and-rear direction by the second correction unit 45 is the same as the operation to correct the position of the sheet S in the front-and-rear direction by the first correction unit 44, and its explanation is omitted.

At the downstream side brunch point DB of the main path Z1, a downstream side brunch guide (not shown) is provided. By the downstream side brunch guide, the sheets S introduced into the main path Z1 continuously at predetermined intervals are guided to the first correction path C1 and to the second correction path C2 alternately. Thereby, the sheets S are introduced to the first correction unit 44 and to the second correction unit 45 alternately.

A configuration that the sheets S are continuously introduced into one of the first correction path C1 and the second correction path C2 may be adopted. For example, a configuration that when one print job instructs a printing for the plurality of sheets S, the sheets S are introduced into one of the first correction path C1 and the second correction path C2 may be adopted.

The sheet S whose position is corrected in the front-and-rear direction by the first correction unit 44 or the second correction unit 45 is discharged through the relay discharge port 51 from the main path Z1, and enters the downstream side conveyance path Y through the downstream side introduction port 38 of the post-processing device 3.

2. Variation of the Sheet Interval

Figure 3:
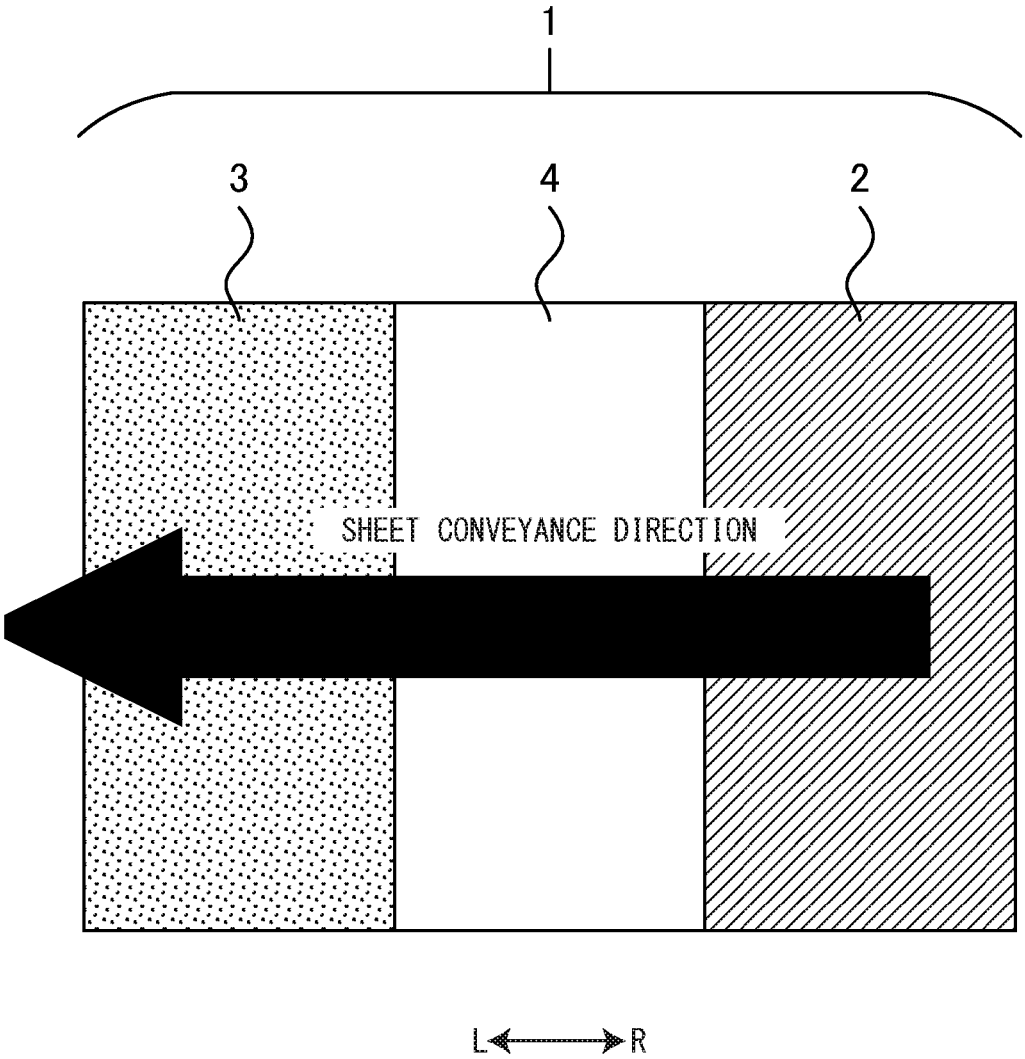
FIG. 3 is a schematic view conceptionally showing the image forming system and a sheet conveyance according to the embodiment of the present disclosure.

FIG. 3 is a view schematically showing the image forming system 1 of the present embodiment. As explained again, the image forming system 1 includes the image forming apparatus 2 which forms the image on the sheet S, the post-processing device 3 (the discharge device) which discharges the sheet S on which the image is formed by the image forming apparatus 2 and the relay conveyance device 4 which relays the sheet S from the image forming apparatus 2 to the post-processing device 3. The sheet S is fed within the image forming apparatus 2, is discharged after the image is formed on the sheet S and then enters the relay conveyance device 4. The sheet S is conveyed along the relay conveyance path Z within the relay conveyance device 3, discharged and then enters the post-processing device 3. The sheet S is subjected to the post-processing, and then discharged from the post-processing device 3.

Figure 4:
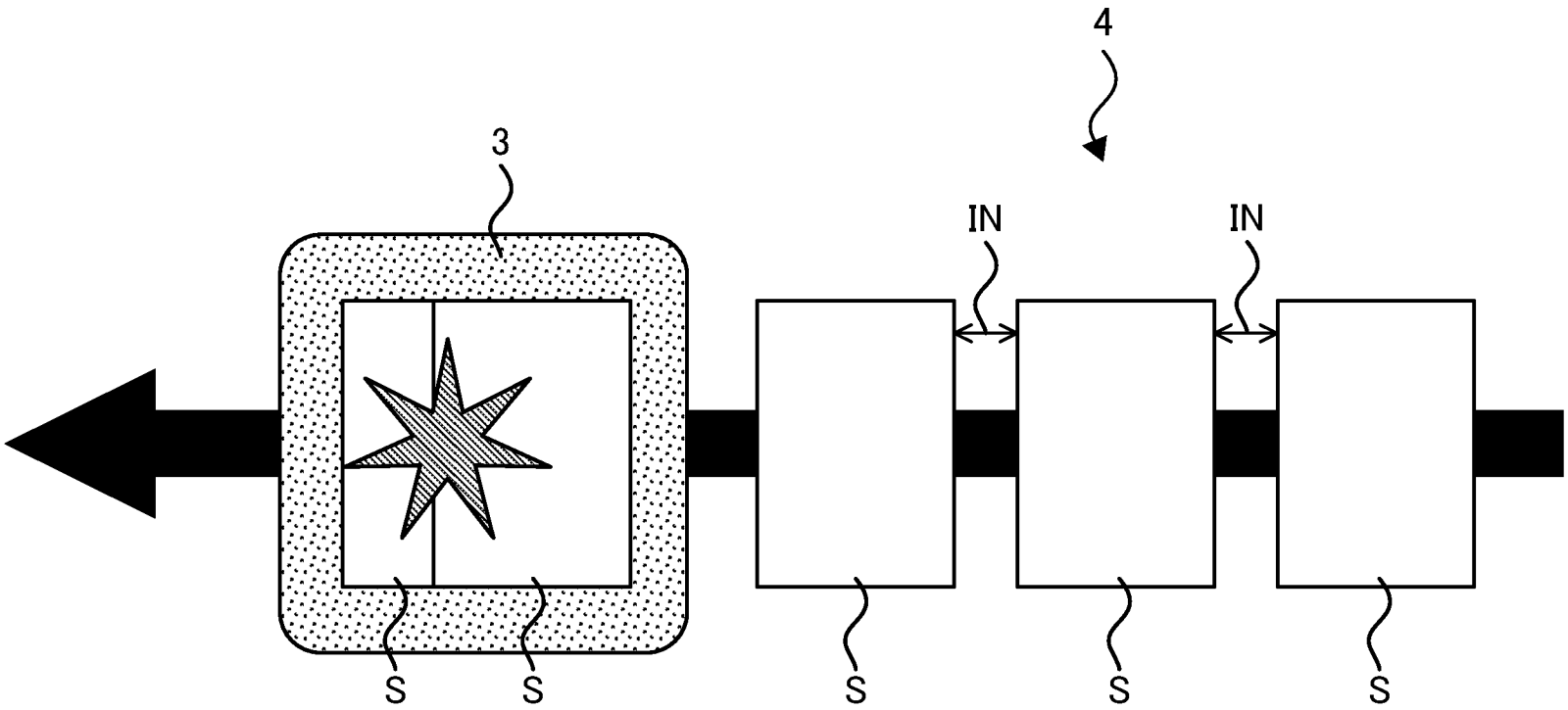
FIG. 4 is a view explaining a sheet interval in the relay conveyance device according to the embodiment of the present disclosure.
Figure 5:
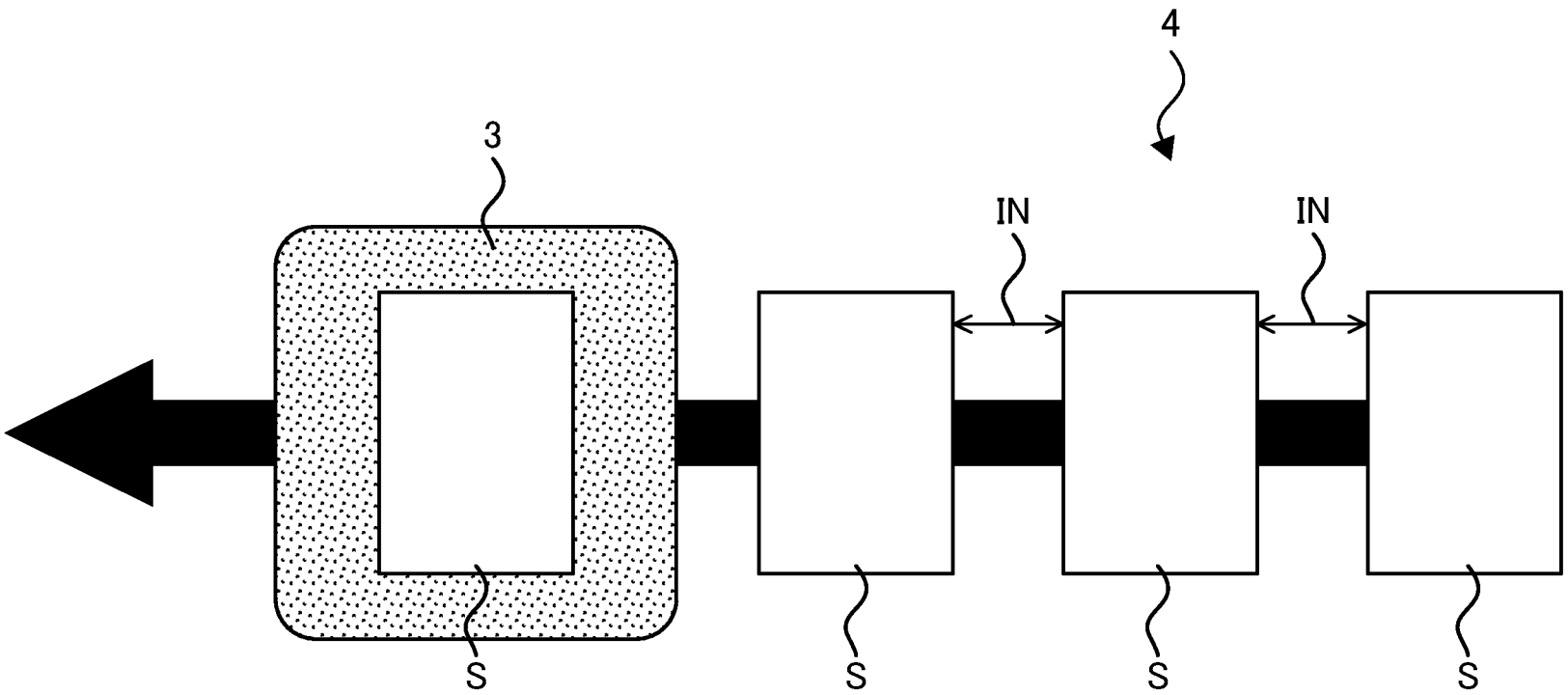
FIG. 5 is a view explaining the sheet interval in the relay conveyance device according to the embodiment of the present disclosure.

FIG. 4 and FIG. 5 are views explaining the sheet interval IN. The sheets S fed continuously are conveyed along the relay conveyance path Z at the sheet intervals IN. The sheet interval IN is preferably close to a predetermined target value T; however, the sheet interval IN is practically varied due to slipping of the sheet S caused by the abrasion of the conveyance roller CR (the conveyance member). The sheet interval IN may be presented by a difference in time (a time difference) or a difference in space (a distance) in the relay control device 80.

For example, as shown in FIG. 4, in a case where the sheet interval IN is shorter than the target value T, the post-processing by the post-processing device 3 cannot be performed in time, and the succeeding sheet S may enter the post-processing device 3 during the post-processing for the preceding sheet S by the post-processing device 3. As a result, a sheet jamming may occur.

On the other hand, as shown in FIG. 5, in a case where the sheet interval IN is longer than the target value T, the post-processing is performed without problems; however, the productivity of the printing processing may not be sufficient for the original performance of the image forming system 1.

Accordingly, in the present embodiment, the correction to bring the sheet interval IN close to the target value T is executed such that the sheet interval IN is specified based on the output from the sheet detection sensor SD and the rotation speed (a conveyance speed) of the conveyance roller CR is controlled (decreased or increased) based on the specified sheet interval IN.

3. Correction Processing for the Sheet Interval

Figure 6:
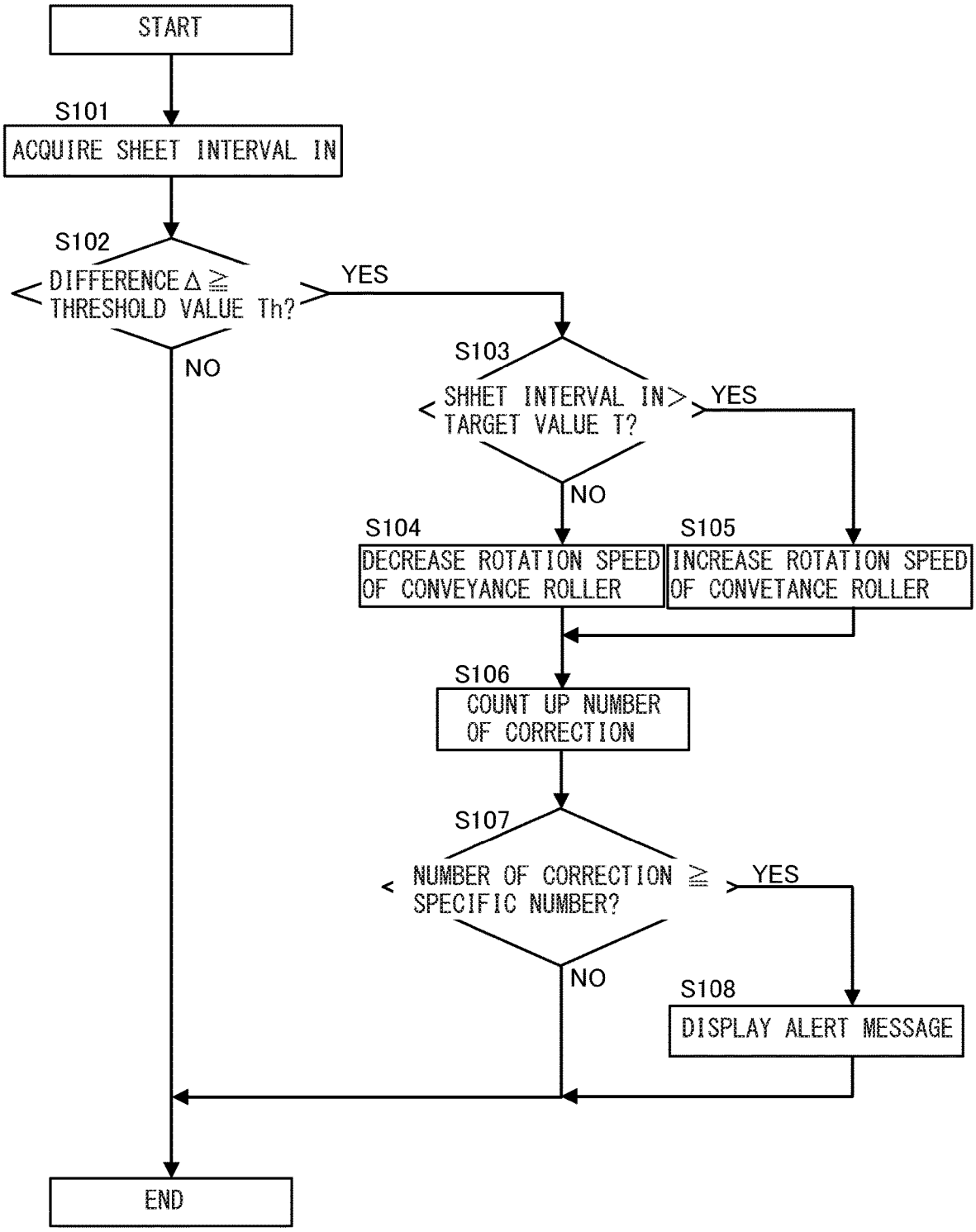
FIG. 6 is a flow chart showing a correction processing according to the embodiment of the present disclosure.

FIG. 6 is a flowchart showing the correction processing for the sheet interval IN in the relay conveyance device 4 according to the present embodiment. When the relay conveyance device 4 receives the sheet S from the image forming apparatus 2, the conveyance processing for the sheet S and the correction processing for the sheet interval IN are executed.

Figure 7:
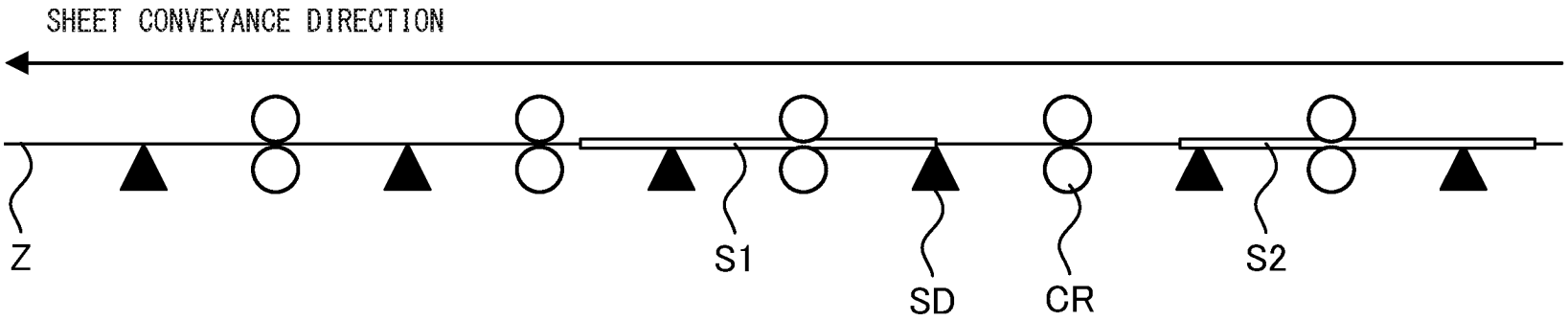
FIG. 7 is a view explaining the correction processing in the relay conveyance device according to the embodiment of the present disclosure.
Figure 8:
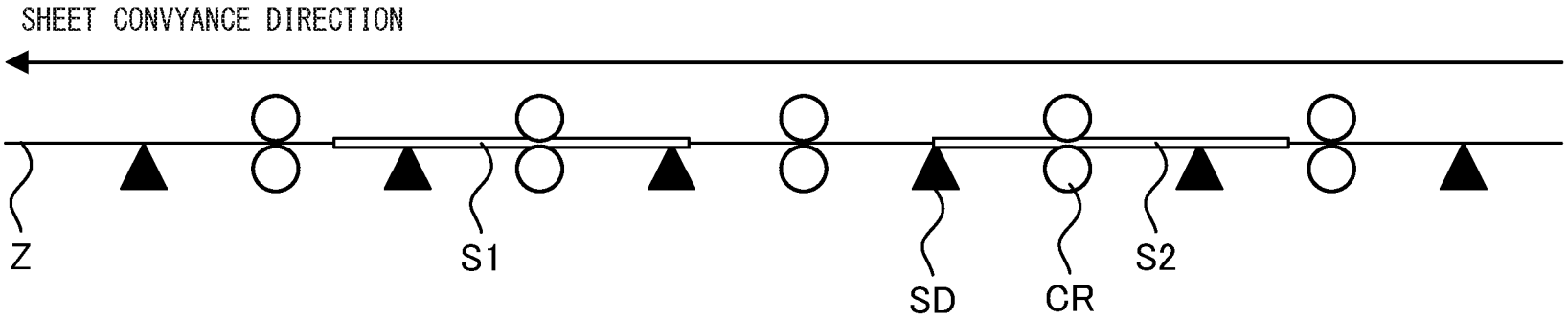
FIG. 8 is a view explaining the correction processing in the relay conveyance device according to the embodiment of the present disclosure.

In the following example, of the sheets S conveyed along the relay conveyance path Z continuously, by focusing attention on the continuous first sheet S1 and second sheet S2 shown in FIG. 7 and FIG. 8, the correction processing will be described. The second sheet S2 is a sheet conveyed along the relay conveyance path Z at the upstream side of the first sheet S1. In the following example, the correction processing is explained by focusing attention on one of the sheet detection sensors SD; however, the correction processing is executed for each of the other sheet detection sensors SD in the same manner.

When the correction processing is started, the arithmetic processing part 81 of the relay control device 80 acquires the sheet interval IN (step S101). More specifically, the arithmetic processing part 81 acquires a period from a detection end time at which the detection of the first sheet S1 by the sheet detection sensor SD is ended (FIG. 7) to a detection start time at which the detection of the second sheet S2 by the sheet detection sensor SD is started (FIG. 8) as the sheet interval IN, and stores it in the storage part 82. Alternatively, the arithmetic processing part 81 may acquire a distance from a tail end of the first sheet S1 to a lead end of the second sheet S2 as the sheet interval IN based on the period from the detection end time of the first sheet S1 to the detection start time of the second sheet S2 and the conveyance speed of the sheet S.

Next, the arithmetic processing part 81 of the relay control device 80 compares the sheet interval IN acquired in step S101 with the target value T stored in the storage part 82 (step S102). In a case where a difference Δ between the sheet interval IN and the target value T is larger than a threshold value Th (S102: YES), the arithmetic processing part 81 judges that it is necessary to correct the sheet interval IN, and proceeds the processing to step S103. On the other hand, in a case where the difference Δ is less than the threshold value Th (S102: NO), the arithmetic processing part 81 judges that it is not necessary to correct the sheet interval IN, and the correction processing for one sheet detection sensor SD and for the first sheet S1 and the second sheet S2 is finished.

In step S103, in a case where the sheet interval IN is smaller than the target value T (S103: NO), the arithmetic processing part 81 of the relay control device 80 proceeds the processing to step S104. In a case where the sheet interval IN is larger than the target value T (S103: YES), the arithmetic processing part 81 of the relay control device 80 proceeds the processing to step S105. In step S104, the arithmetic processing part 81 of the relay control device 80 decreases the rotation speed of the conveyance roller CR so as to widen the sheet interval IN. On the other hand, in step S105, the arithmetic processing part 81 of the relay control device 80 increases the rotation speed of the conveyance roller CR so as to shorten the sheet interval IN.

Next, the arithmetic processing part 81 of the relay control device 80 counts up a number of rotation speed decreasing or rotation speed increasing (a number of correction processing) for the conveyance roller CR whose rotation speed is decreased or increased in step S104 or step S105 (step S106). Then, the arithmetic processing part 81 judges whether the number of rotation speed decreasing or rotation speed decreasing (the number of correction processing) is over a specific number or not, based on the result of the count-up in step 106 (step S107).

In a case where the number of correction processing is larger than the specific number (S107: YES), the arithmetic processing part 81 of the relay control device 80 notifies the image forming apparatus 2 so as to display an alert message for the corresponding conveyance roller CR (step S108). When receiving the above notification, the control device of the image forming apparatus 2 displays the alert message prompting a replacement of the conveyance roller CR on the touch panel 23 of the image forming apparatus 2.

That is, the relay control device 80 counts the number of rotation speed decreasing or rotation speed increasing (the number of correction processing) for each conveyance roller CR, and then notifies the image forming apparatus 2 so as to display the alert message for the conveyance roller CR whose counted number is over the specific number. In the present embodiment, the specific number is 40 or 50, for example.

In a case where the number of correction processing is less than the specific number (S107: NO), or, after the step S108 is completed, the arithmetic processing part 81 of the relay control device 80 finishes the correction processing for one sheet detection sensor SD and for the first sheet S1 and the second sheet S2.

In the above steps S104 and S105, the conveyance roller CR whose rotation speed is decreased or increased by the relay control device 80 is the conveyance roller CR which conveys the second sheet S2 at the time when the step S104 or S105 is executed, for example.

Alternatively, the relay control device 80 may decrease or decrease the rotation speed of the conveyance roller CR arranged at the downstream side of the conveyance roller CR which conveys the second sheet S, in step S104 or S105.

In the above correction processing, after the conveyance roller CR whose rotation speed is decreased or increased finishes the conveyance of the second sheet S2, the relay control device 80 preferably controls the conveyance roller CR so as to restore its rotation speed to the original speed before the decreasing or increasing of the rotation speed.

Additionally, in the above correction processing, the relay control device 80 preferably decreases or increases the rotation speed of the plurality of conveyance rollers CR conveying the second sheet S2 sequentially until the difference Δ between the sheet interval IN and the target value T is less than the threshold value Th.

4. Correction Processing for Each Conveyance Section as a Unit

Although the correction processing is executed for each conveyance roller CR in the above embodiment, the correction processing may be executed for each of the conveyance sections P into which the relay conveyance path Z is divided. The relay conveyance path Z is divided into the conveyance sections P, and each conveyance section P is provided with the plurality of conveyance rollers CR.

With reference to FIG. 1 again, an example of the conveyance section P will be described. The relay conveyance path Z is divided into four conveyance sections P, for example. The first section P1 includes the portion of the relay conveyance pats Z from the relay introduction port 50 to the upstream side join point UJ. The second conveyance section P2 includes the portion of the relay conveyance path Z from the downstream side of the upstream side join point UJ to the upstream side of the downstream side brunch point DB. The third conveyance path P3 includes the portion of the relay conveyance path Z from the downstream side brunch point DB to the downstream side join point DJ. The fourth conveyance path P4 includes the portion of the relay conveyance path Z from the downstream side of the downstream side join point DJ to the relay discharge port 51. Because the present embodiment supposes a configuration that the sheet S is conveyed to one of the inversion units 41 and 42 and one of the correction units 44 and 45, the relay conveyance path Z within each conveyance section P is single (not parallel).

Figure 9:
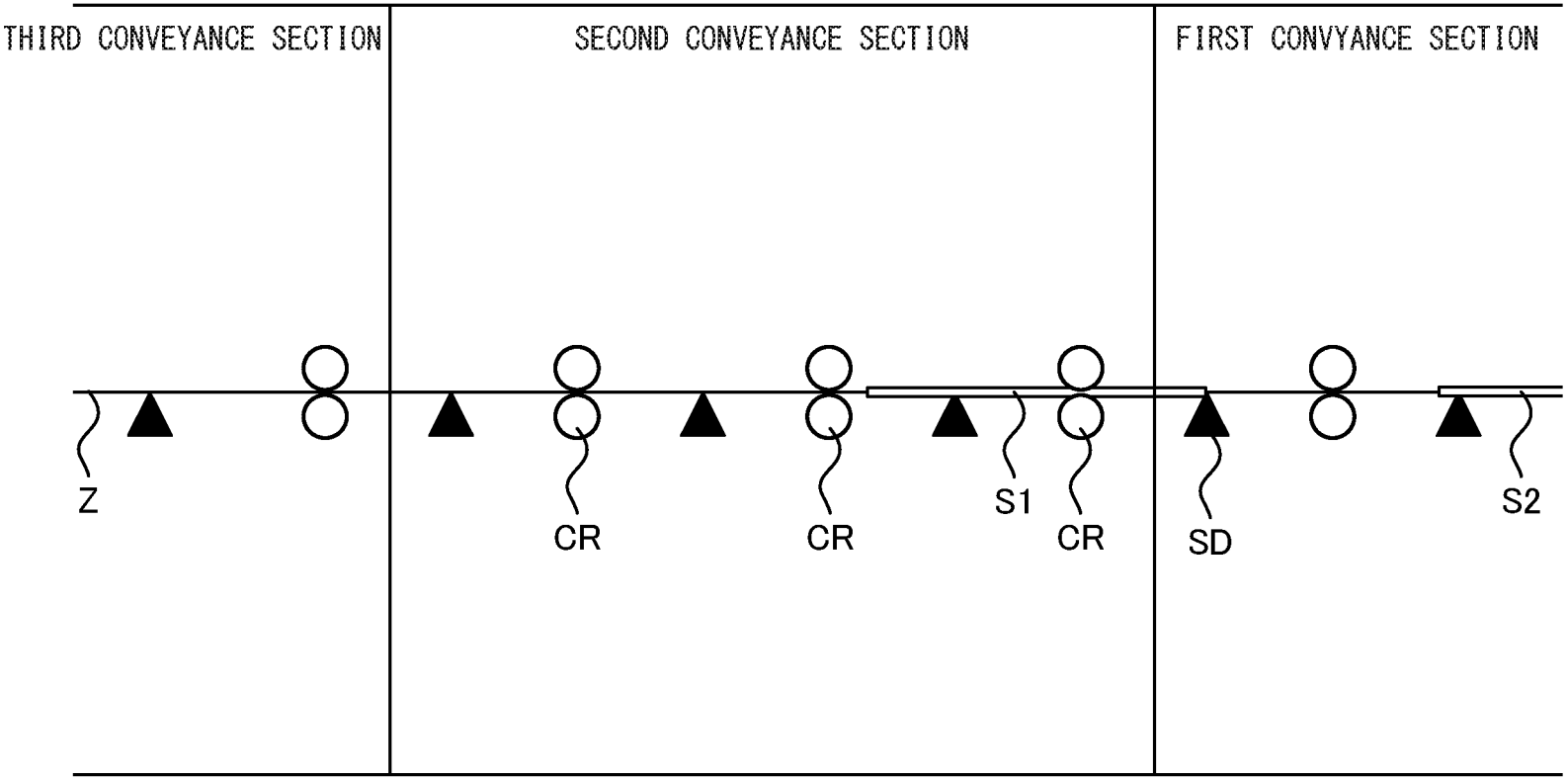
FIG. 9 is a view explaining the correction processing in the relay conveyance device according to the embodiment of the present disclosure.
Figure 10:
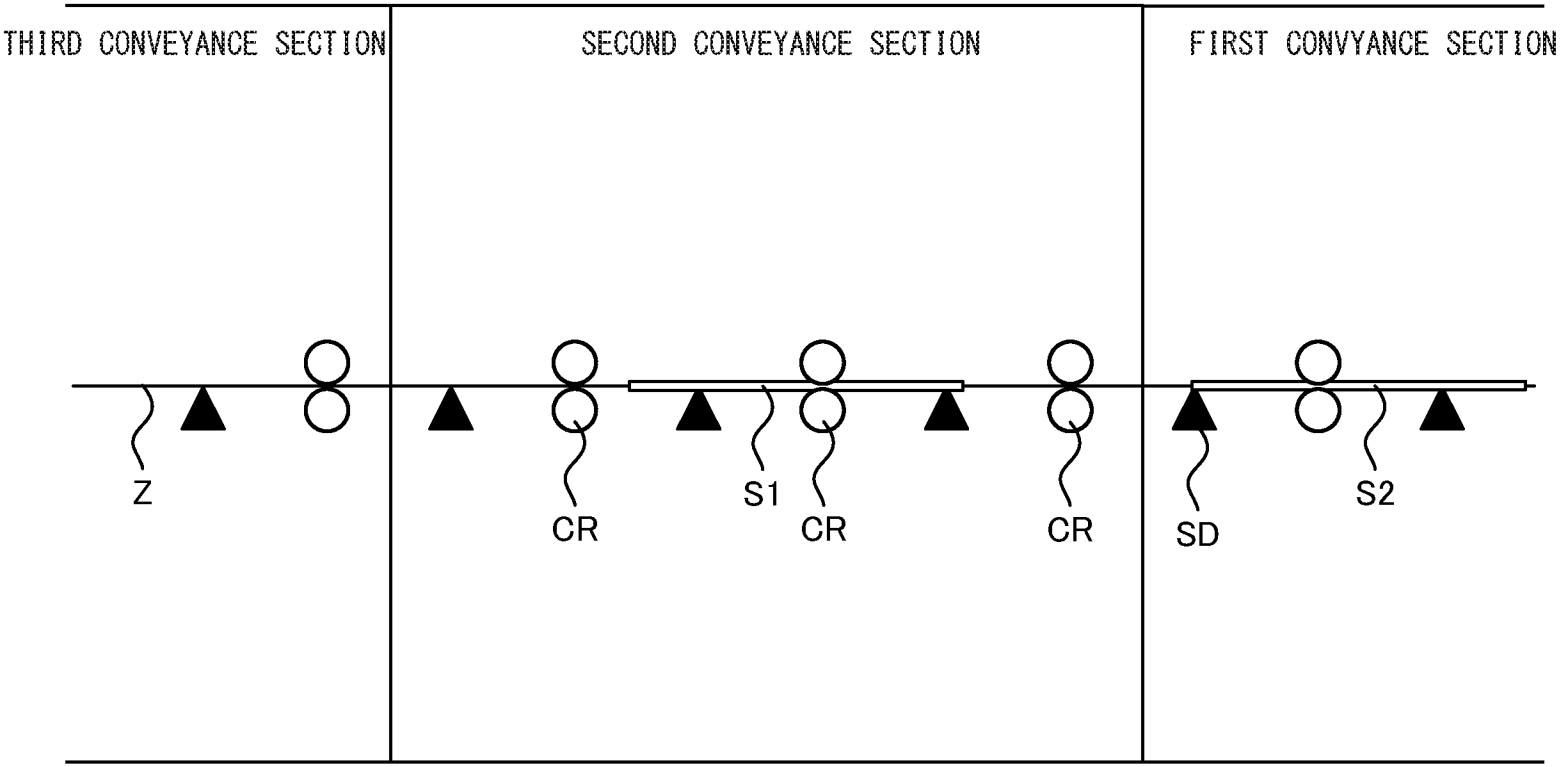
FIG. 10 is a view explaining the correction processing in the relay conveyance device according to the embodiment of the present disclosure.

With reference to FIG. 9 and FIG. 10, the correction processing for each conveyance section P as a unit will be described. The basic operation is the same as that shown by the flowchart in FIG. 6. In step S101, the arithmetic processing part 81 acquires the period from the detection end time of the first sheet S1 by the sheet detection sensor SD within the first conveyance section P1 (FIG. 9) to the detection start time of the second sheet S2 by the sheet detection sensor SD within the first conveyance section P1 (FIG. 10) as the sheet interval IN, and then stores it in the storage part 82. In a case where the difference Δ between the sheet interval IN and the target value T is larger than the threshold value Th (S102: YES), the arithmetic processing part 81 proceeds the processing to step S103.

In a case where the sheet interval IN is smaller than the target value T (S103: NO), the arithmetic processing part 81 decreases the rotation speed of the plurality of conveyance rollers CR within the second conveyance section P2 so as to widen the sheet interval IN (step S104). In a case where the sheet interval IN is larger than the target value T (S103: YES), the arithmetic processing part 81 increases the rotation speed of the plurality of conveyance rollers CR within the second conveyance section P2 so as to shorten the sheet interval IN (step S105).

Preferably, in step S106, the arithmetic processing part 81 of the relay control device 80 may count up the number of rotation speed increasing or rotation speed decreasing (the number of correction processing) for the conveyance section P provided with the conveyance roller CR whose rotation speed is increased or decreased in step S104 or step S105. Then, the arithmetic processing part 81 judges whether the number of rotation speed increasing or rotation speed decreasing caused by the conveyance section P is over the specific number or not, based on the result of the count-up in step S106 (step S107). In a case where the number of rotation speed increasing or rotation speed decreasing is over the specific number (S107: YES), the arithmetic processing part 81 of the relay control device 80 notifies the image forming apparatus 2 to display an alert message for the corresponding conveyance section P (step S108). When receiving the notification, the control device of the image forming apparatus 2 displays the alert message showing frequent occurrences of the correction caused by the conveyance section P, on the touch panel 23 of the image forming apparatus 2.

5. Technical Effect of the Present Embodiment

In the above described embodiment, the relay conveyance device 4 arranged between the image forming apparatus 1 and the post-processing device 3 includes the relay conveyance path Z, the conveyance rollers CR, the sheet detection sensors SD and the relay control device 80. The sheet S is conveyed along the relay conveyance path Z from the image forming apparatus 1 to the post-processing device 3. The conveyance rollers CR are provided along the relay conveyance path Z and convey the sheet S from an upstream side to a downstream side of the relay conveyance path Z. The sheet detection sensor SD is provided along the relay conveyance path Z and detects the sheet S conveyed along the relay conveyance path Z by the conveyance rollers CR. In a state where the first sheet S1 and the second sheet S2 positioned at the upstream side from the first sheet S1 are conveyed along the relay conveyance path Z, the relay control device 80 compares the sheet interval IN from a detection end of the first sheet S1 by the sheet detection sensor SD to a detection start of the second sheet S2 by the detection sensor SD with the predetermined target value T. Then, when the sheet interval IN is smaller than the target value T, the relay control device 80 decreases the conveyance speed of the conveyance roller CR so as to widen the sheet interval IN, and when the sheet interval IN is larger than the target value T, the relay conveyance device 80 increases the conveyance speed of the conveyance roller CR so as to shorten the sheet interval IN. According to the above configuration, the increasing and decreasing of the conveyance speed of the conveyance roller CR is controlled based on the sheet interval IN acquired during the conveyance of the sheet S so that it becomes possible to suitably correct the variation in the sheet interval IN in the relay conveyance device 4 during the conveyance of the sheet S.

Additionally, the above embodiment has a configuration that the conveyance roller CR whose conveyance speed is decreased or increased by the relay control device 80 so as to widen or shorten the sheet interval IN is the conveyance roller CR which conveys the second sheet S2. According to the configuration, the conveyance speed of the conveyance roller CR which just conveys the second sheet S2 is increased or decreased so that it becomes possible to correct the sheet interval IN effectively and immediately.

Additionally, the above embodiment has a configuration that the conveyance roller CR whose conveyance speed is decreased or increased by the relay control device 80 so as to widen or shorten the sheet interval IN is the conveyance roller CR arranged at the downstream side of the conveyance roller CR which conveys the second sheet S2. According to the configuration, because the conveyance speed of the conveyance roller CR which is to convey the second sheet S2 in future is increased or decreased, it becomes possible to correct the sheet interval IN more surely (for example, even if there is a time lag between the correction processing by the relay control device 80 and the practical increasing or decreasing of the conveyance speed of the conveyance roller CR).

Additionally, the above embodiment has a configuration that when the conveyance roller CR whose conveyance speed is decreased or increased finishes the conveyance of the second sheet S2, the relay control device 80 controls the conveyance roller CR so as to restore the conveyance speed to an original speed before the decreasing or increasing of the conveyance speed. According to the configuration, because the conveyance speed of the conveyance roller CR is returned to the original speed after the correction of the variation of the specific sheet interval IN, it becomes possible to keep the constant control performance of the relay control device 80.

Additionally, the above embodiment has a configuration that the relay control device 80 sequentially decreases or increases the conveyance speed of the conveyance rollers CR which convey the second sheet S2 until a difference Δ between the sheet interval IN and the target value T is less than the predetermined threshold value Th. According to the configuration, because the conveyance speed correction of the conveyance roller CR is continuously executed until the sheet interval IN between the first sheet S1 and the second sheet S2 becomes small sufficiently, it becomes possible to correct the variation in the sheet interval IN more surely.

Additionally, the above embodiment has a configuration that the relay control device 80 counts a number of the increasing or decreasing the conveyance speed for each conveyance roller CR, and notifies the image forming apparatus 2 so as to display an alert message for the conveyance roller CR of which the counted number is over the specific number. According to the configuration, because the alert is displayed on the conveyance roller CR of which the number (the number of the correction) of the increasing or decreasing the conveyance speed is large, that is, the conveyance roller CR which is assumed to be deteriorated, a user can recognize the conveyance roller CR to be replaced. Accordingly, it becomes possible to improve a maintenance performance of the relay conveyance device 4.

Additionally, the above embodiment has a configuration that the relay conveyance path Z is divided into a plurality of conveyance sections P, when the sheet interval IN is smaller than the target value T, the relay control device 80 decreases the conveyance speed of the conveyance roller CR provided in the conveyance section P so as to widen the sheet interval IN, and when the sheet interval IN is larger than the target value T, the relay control device 80 increases the conveyance speed of the conveyance roller CR provided in the conveyance section P so as to shorten the sheet interval IN. According to the above configuration, because the conveyance roller CR is controlled for each conveyance section P, it becomes possible to achieve a simple control compared with a case where each conveyance roller CR is controlled individually.

According to the configuration of the above embodiment, the image forming system 1 including the image forming apparatus 2 and the post-processing device 4 can be achieved.

6. Modified Example

The inversion unit according to the above embodiment makes the sheet introduced in the inversion area invert the conveyance direction so as to invert the sheet. On the other hand, in the other embodiments, the sheet may be inverted by circulating the sheet along a loop-shaped inversion path. The inversion unit may have any configuration such that the sheet is inverted.

The correction unit according to the above embodiment makes the pairs of correction rollers between which the sheet is put move so as to correct the position of the sheet in the direction perpendicular to the conveyance direction of the sheet. On the other hand, in the other embodiments, the correction unit may have a pair of cursors contacting with both side edges of the sheet, and correct the position of the sheet in the direction perpendicular to the conveyance direction of the sheet. The correction unit may have any configuration such that the position of the sheet can be corrected in the direction perpendicular to the conveyance direction of the sheet.

In the above embodiments, the post-processing device (so-called finisher) including the post-processing mechanism is used as the discharge device. On the other hand, in the other embodiments, a sheet stacking device (so-called stacker) not including the post-processing mechanism may be used as the discharge device.

The invention claimed is:

1. A relay conveyance device, comprising:

a relay conveyance path arranged between an image forming apparatus forming an image on a sheet and a discharge device discharging the sheet on which the image is formed by the image forming apparatus, the sheet being conveyed along the relay conveyance path from the image forming apparatus to the discharge device;

a plurality of conveyance members provided along the relay conveyance path and configured to convey the sheet from an upstream side to a downstream side of the relay conveyance path;

at least one detection member provided along the relay conveyance path and configured to detect the sheet conveyed along the relay conveyance path by the conveyance members; and a control device configured to decrease or increase a conveyance speed of the conveyance members, wherein the control device executes a correction processing such that, in a state where a first sheet and a second sheet positioned at the upstream side from the first sheet are conveyed along the relay conveyance path, a sheet interval from a detection end of the first sheet by the detection member to a detection start of the second sheet by the detection member is compared with a predetermined target value, when the sheet interval is smaller than the predetermined target value, the conveyance speed of the conveyance member arranged on the downstream side of the conveyance member which conveys the second sheet is decreased so as to widen the sheet interval, and when the sheet interval is larger than the predetermined target value, the conveyance speed of the conveyance member arranged on the downstream side of the conveyance member which conveys the second sheet is increased so as to shorten the sheet interval.

2. The relay conveyance device according to claim 1, wherein the control device sequentially decreases or increases the conveyance speed of the conveyance members which convey the second sheet until a difference between the sheet interval and the predetermined target value is less than a predetermined threshold value.

3. The relay conveyance device according to claim 1, wherein the correction processing is executed for each conveyance member.

4. A relay conveyance device comprising:

a relay conveyance path arranged between an image forming apparatus forming an image on a sheet and a discharge device discharging the sheet on which the image is formed by the image forming apparatus, the sheet being conveyed along the relay conveyance path from the image forming apparatus to the discharge device;

a plurality of conveyance members provided along the relay conveyance path and configured to convey the sheet from an upstream side to a downstream side of the relay conveyance path;

at least one detection member provided along the relay conveyance path and configured to detect the sheet conveyed along the relay conveyance path by the conveyance members; and a control device configured to decrease or increase a conveyance speed of the conveyance members, wherein the control device executes a correction processing such that, in a state where a first sheet and a second sheet positioned at the upstream side from the first sheet are conveyed along the relay conveyance path, a sheet interval from a detection end of the first sheet by the detection member to a detection start of the second sheet by the detection member is compared with a predetermined target value, when the sheet interval is smaller than the predetermined target value, the conveyance speed of the conveyance member which conveys the second sheet or the conveyance member arranged on the downstream side of the conveyance member which conveys the second sheet is decreased so as to widen the sheet interval, and when the sheet interval is larger than the predetermined target value, the conveyance speed of the conveyance member which conveys the second sheet or the conveyance member arranged on the downstream side of the conveyance member which conveys the second sheet is increased so as to shorten the sheet interval, wherein the control device counts a number of the correction processing for each conveyance member, and notifies the image forming apparatus so as to display an alert message for the conveyance member of which the counted number is over a specific number.

5. The relay conveyance device according to claim 4, wherein the relay conveyance path is divided into a plurality of conveyance sections, the detection member is provided in each conveyance section, and when the sheet interval is smaller than the predetermined target value, the control device decreases the conveyance speed of the conveyance members provided in the conveyance section so as to widen the sheet interval, and when the sheet interval is larger than the predetermined target value, the control device increases the conveyance speed of the conveyance members provided in the conveyance section so as to shorten the sheet interval.

6. The relay conveyance device according to claim 5, wherein the control device counts a number of the correction processing for each conveyance section, and the control device notifies the image forming apparatus so as to display an alert message for the conveyance section in which the counted number is over a specific number.

7. An image forming system comprising:

an image forming apparatus configured to form an image on a sheet, a discharge device configured to discharge the sheet on which the image is formed by the image forming apparatus; and a relay conveyance device configured to relay the sheet from the image forming apparatus to the discharge device, wherein the relay conveyance device includes:

a relay conveyance path arranged between the image forming apparatus and the discharge device, the sheet being conveyed along the relay conveyance path from the image forming apparatus to the discharge device;

a plurality of conveyance members provided along the relay conveyance path and configured to convey the sheet from an upstream side to a downstream side of the relay conveyance path;

at least one detection member provided along the relay conveyance path and configured to detect the sheet conveyed along the relay conveyance path by the conveyance members; and a control device configured to decrease or increase a conveyance speed of the conveyance members, wherein the control device executes a correction processing such that, in a state where a first sheet and a second sheet positioned at the upstream side from the first sheet are conveyed along the relay conveyance path, a sheet interval from a detection end of the first sheet by the detection member to a detection start of the second sheet by the detection member is compared with a predetermined target value, when the sheet interval is smaller than the predetermined target value, the conveyance speed of the conveyance member arranged on the downstream side of the conveyance member which conveys the second sheet is decreased so as to widen the sheet interval, and when the sheet interval is larger than the predetermined target value, the conveyance speed of the conveyance member arranged on the downstream side of the conveyance member which conveys the second sheet is increased so as to shorten the sheet interval.

* * * * *